US007345016B2

(12) United States Patent
Willey et al.

(10) Patent No.: US 7,345,016 B2
(45) Date of Patent: Mar. 18, 2008

(54) PHOTO BLEACH LIPOPHILIC FLUID CLEANING COMPOSITIONS

(75) Inventors: Alan David Willey, Cincinnati, OH (US); Brian Jeffreys, Grimbergen (BE); Anthony Harriman, Vidauban (FR); Vladimir Garstein, Cincinnati, OH (US); William Michael Scheper, Guilford, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 442 days.

(21) Appl. No.: 10/875,908

(22) Filed: Jun. 24, 2004

(65) Prior Publication Data

US 2004/0266648 A1 Dec. 30, 2004

Related U.S. Application Data

(60) Provisional application No. 60/483,351, filed on Jun. 27, 2003.

(51) Int. Cl.

| | |
|---|---|
| ***C11D 1/72*** | (2006.01) |
| ***C11D 3/20*** | (2006.01) |
| ***C11D 3/28*** | (2006.01) |
| ***C11D 9/36*** | (2006.01) |
| ***B08B 3/04*** | (2006.01) |

(52) U.S. Cl. ..... 510/466; 510/302; 510/307; 510/309; 510/324; 510/326; 510/360; 510/367; 510/375; 510/421; 510/445; 510/492; 8/137

(58) Field of Classification Search ..... 510/302, 510/307, 309, 324, 326, 360, 367, 375, 421, 510/445, 466, 492; 8/137
See application file for complete search history.

(56) References Cited

U.S. PATENT DOCUMENTS

| | | | | |
|---|---|---|---|---|
| 3,576,747 | A | | 4/1971 | Walles et al. |
| 3,635,667 | A | | 1/1972 | Keay et al. |
| 4,094,806 | A | * | 6/1978 | Wiers ..... 510/301 |
| 4,097,397 | A | | 6/1978 | Mizutani et al. |
| 4,102,824 | A | | 7/1978 | Mizutani et al. |
| 4,267,077 | A | | 5/1981 | Niimi et al. |
| 4,421,668 | A | | 12/1983 | Cox et al. |
| 4,639,321 | A | | 1/1987 | Barrat et al. |
| 4,685,930 | A | | 8/1987 | Kasprzak et al. |
| 4,708,807 | A | | 11/1987 | Kemerer et al. |
| 4,909,962 | A | | 3/1990 | Clark |
| 4,961,755 | A | | 10/1990 | Bruttel et al. |
| 5,037,485 | A | | 8/1991 | Chromecek et al. |
| 5,057,240 | A | | 10/1991 | Madore et al. |
| 5,116,426 | A | | 5/1992 | Asano et al. |
| 5,271,775 | A | | 12/1993 | Asano et al. |
| 5,302,313 | A | | 4/1994 | Asano et al. |
| 5,360,571 | A | | 11/1994 | Kilgour et al. |
| 5,443,747 | A | | 8/1995 | Inada et al. |
| 5,503,681 | A | | 4/1996 | Inada et al. |
| 5,503,778 | A | | 4/1996 | Liu et al. |
| 5,520,827 | A | | 5/1996 | Danner |
| 5,593,507 | A | | 1/1997 | Inada et al. |
| 5,597,792 | A | | 1/1997 | Klier et al. |
| 5,628,833 | A | | 5/1997 | McCormack et al. |
| 5,676,705 | A | | 10/1997 | Jureller et al. |
| 5,683,473 | A | | 11/1997 | Jureller et al. |
| 5,683,977 | A | | 11/1997 | Jureller et al. |
| 5,690,750 | A | | 11/1997 | Inada et al. |
| 5,705,562 | A | | 1/1998 | Hill et al. |
| 5,707,613 | A | | 1/1998 | Hill et al. |
| 5,716,456 | A | | 2/1998 | Inada et al. |
| 5,722,781 | A | | 3/1998 | Yamaguchi |
| 5,741,365 | A | | 4/1998 | Inada et al. |
| 5,769,962 | A | | 6/1998 | Inada et al. |
| 5,783,092 | A | | 7/1998 | Brown et al. |
| 5,811,383 | A | | 9/1998 | Klier et al. |
| 5,858,022 | A | | 1/1999 | Romack et al. |
| 5,865,852 | A | | 2/1999 | Berndt et al. |
| 5,866,005 | A | | 2/1999 | DeSimone et al. |
| 5,876,510 | A | | 3/1999 | Kuemin et al. |
| 5,877,133 | A | | 3/1999 | Good |
| 5,888,250 | A | | 3/1999 | Hayday et al. |
| 5,929,012 | A | | 7/1999 | Del Duca et al. |
| 5,942,007 | A | | 8/1999 | Berndt et al. |
| 5,944,996 | A | | 8/1999 | DeSimone et al. |

(Continued)

FOREIGN PATENT DOCUMENTS

| | | |
|---|---|---|
| CA | 1 239 326 | 7/1988 |

(Continued)

OTHER PUBLICATIONS

Trilo "Critical Micelle Density for the Self-Assembly of Block Copolymer Surfactants in Supercritical Carbon Dioxide" Langmuir 2000, pp. 416-421, Oct. 28, 1999.

(Continued)

*Primary Examiner*—Brian Mruk
(74) *Attorney, Agent, or Firm*—Kim William Zerby; Steven W. Miller

(57) ABSTRACT

The present invention relates to compositions comprising photosenitizer that can be used to provide lipophilic fluids with bleaching capabilities, lipophilic fluid cleaning compositions having bleaching capabilities and processes of making and using same. Such compositions provide the cleaning benefits of typical lipophilic solvents and additional cleaning benefits that include bleaching.

8 Claims, No Drawings

U.S. PATENT DOCUMENTS

| | | | | |
|---|---|---|---|---|
| 5,954,869 | A | 9/1999 | Elfersy et al. | |
| 5,977,040 | A | 11/1999 | Inada et al. | |
| 5,977,045 | A | 11/1999 | Murphy | |
| 5,985,810 | A | 11/1999 | Inada et al. | |
| 6,013,683 | A | 1/2000 | Hill et al. | |
| 6,042,617 | A | 3/2000 | Berndt et al. | |
| 6,042,618 | A | 3/2000 | Berndt et al. | |
| 6,056,789 | A | 5/2000 | Berndt et al. | |
| 6,059,845 | A | 5/2000 | Berndt et al. | |
| 6,060,546 | A | 5/2000 | Powell et al. | |
| 6,063,135 | A | 5/2000 | Berndt et al. | |
| 6,083,901 | A | 7/2000 | Perry et al. | |
| 6,086,635 | A | 7/2000 | Berndt et al. | |
| 6,114,295 | A | 9/2000 | Murphy | |
| 6,114,298 | A | 9/2000 | Petri et al. | |
| 6,131,421 | A | 10/2000 | Jureller et al. | |
| 6,136,766 | A | 10/2000 | Inada et al. | |
| 6,148,644 | A | 11/2000 | Jureller et al. | |
| 6,156,074 | A | 12/2000 | Hayday et al. | |
| 6,177,399 | B1 | 1/2001 | Mei et al. | |
| 6,200,352 | B1 | 3/2001 | Romack et al. | |
| 6,200,393 | B1 | 3/2001 | Romack et al. | |
| 6,200,943 | B1 | 3/2001 | Romack et al. | |
| 6,204,233 | B1 | 3/2001 | Smith et al. | |
| 6,228,826 | B1 | 5/2001 | DeYoung et al. | |
| 6,242,408 | B1 | 6/2001 | Elms et al. | |
| 6,258,130 | B1 | 7/2001 | Murphy et al. | |
| 6,262,005 | B1 * | 7/2001 | Willey et al. | 510/301 |
| 6,273,919 | B1 | 8/2001 | Hayday et al. | |
| 6,291,415 | B1 | 9/2001 | Watson et al. | |
| 6,309,425 | B1 | 10/2001 | Murphy et al. | |
| 6,310,029 | B1 | 10/2001 | Kilgour et al. | |
| 6,312,476 | B1 | 11/2001 | Perry et al. | |
| 6,313,079 | B1 | 11/2001 | Murphy et al. | |
| 6,368,359 | B1 | 4/2002 | Perry et al. | |
| 6,413,924 | B2 * | 7/2002 | Willey | 510/301 |
| 6,420,331 | B1 | 7/2002 | Bettiol et al. | |
| 6,583,105 | B1 | 6/2003 | Hohener et al. | |
| 6,610,108 | B2 | 8/2003 | Perry et al. | |
| 6,706,677 | B2 | 3/2004 | Burns | |
| 6,734,155 | B1 | 5/2004 | Herbot et al. | |
| 6,894,014 | B2 * | 5/2005 | Deak et al. | 510/285 |
| 2001/0020308 | A1 | 9/2001 | Murphy et al. | |
| 2001/0034912 | A1 | 11/2001 | Kilgour et al. | |
| 2002/0004953 | A1 | 1/2002 | Perry et al. | |
| 2002/0115582 | A1 | 8/2002 | Perry et al. | |
| 2002/0133885 | A1 | 9/2002 | Noyes et al. | |
| 2002/0174493 | A1 | 11/2002 | Perry et al. | |
| 2003/0074742 | A1 | 4/2003 | Perry et al. | |
| 2003/0119699 | A1 | 6/2003 | Miracle | |

FOREIGN PATENT DOCUMENTS

| | | | |
|---|---|---|---|
| DE | 37 39 711 | A1 | 6/1989 |
| EP | 003 149 | A2 | 7/1979 |
| EP | 0 479 146 | B1 | 12/1996 |
| EP | 1 041 189 | A1 | 10/2000 |
| EP | 1 092 803 | A1 | 4/2001 |
| JP | 01 188595 | A | 7/1989 |
| JP | 02 166198 | A | 6/1990 |
| JP | 02 202599 | A | 8/1990 |
| JP | 02 222496 | A | 9/1990 |
| JP | 04 323299 | A | 11/1992 |
| JP | 05 051598 | A | 3/1993 |
| JP | 05 239766 | A | 9/1993 |
| JP | 08 073837 | A | 3/1996 |
| JP | 09 143497 | A | 6/1997 |
| JP | 10-017891 | | 1/1998 |
| JP | 11-092784 | | 4/1999 |
| JP | 11-323381 | | 11/1999 |
| JP | 11-323383 | | 11/1999 |
| JP | 2000-144175 | | 5/2000 |
| JP | 2000-192085 | | 7/2000 |
| JP | 2000-290689 | A | 10/2000 |
| WO | WO 99/57358 | | 11/1999 |
| WO | WO 00/04221 | | 1/2000 |
| WO | WO 00/04222 | | 1/2000 |
| WO | WO 00/63340 | | 10/2000 |
| WO | WO 01/06051 | A1 | 1/2001 |
| WO | WO 01/34613 | A1 | 5/2001 |
| WO | WO 01/40567 | A1 | 6/2001 |
| WO | WO 02/97024 | A1 | 5/2002 |

OTHER PUBLICATIONS

Sarbu et al. "Non-Fluorous Polymers with Very High Solubility in Supercritical CO2 Down to Low Pressures" Letters to Nature, pp. 165-168, May 11, 2000.

C. Schmidtz "A New Access to the Anthracene Core" "Synthesis of Two Water Soluble Singlet Oxygen Traps Derived from 1,3-Diphenylisobenzofuran and 9,10-Diphenylanthracene" Tetrahedrun vol. 38, No. 10, pp. 1425-1430, 1982, no month given.

Foote "Photosensitized Oxygenation of Alkyl-Substituted Furans" Tetrahedron 1967, vol. 23, pp. 2583-2599 Per Gamon Press Ltd., Nov. 21, 1966.

Saito Formation of Superoxide on from Siglet Oxygen. One the Use of Water-Soluble Singlet Oxygen Source, J. Am. Chem Soc. 1981, 103, pp. 188-190, 1981, no month given.

Gandin "Quantum Yield of Singlet Oxygen Production by Xanthene Derivatvies" Photochemistry and Photobiology vol. 37, No. 3, pp. 271-278, 1983, no month given.

Botsivali "A New Trap for Singlet Oxygen in Aqueous Solution" Inorganic Chemistry Laboratories, Imperial College London, pp. 1114-1116, 1979, no month given.

Zahir "Yields of Singlet Dioxygen Producted by the Reaction between the excited state of tri(bipyridine)ruthenium(II) and triplet dioxygen in various solvents" J. Photochem, Photobiol, A. Chem, 63 (1992) pp. 167-172, 1992, no month given.

Konopelski "Synthesis, Cation Binding, and Photophysical Properties and Macrobicylic Anthraceno-cryptands" J. Chem, 1985 pp. 433-436, 1985, no month given.

Aubry "Kinetic Studies of Self-Sensitized Photooxygenation in $H_20$ and $D_20$ of a water-soluble Rubrene Derivative", Photochemistry and Photobiology, vol. 33, pp. 155-158, 1981, no month given.

Aubry "A Water-Soluble Rubrene Derivative Synthesis, Properties and Trapping of $^10_2$ in Aqueous Solution" Photochemistry and Photobiology, vol. 33 pp. 149-153, 1981, no month given.

Usui "An Efficient Regeneration of Singlet Oxygen from 2,5-Diphenylfuran Endoperoxide Produced by a Dye-Sensitized Oxygenation" 1987 The Chemical Society of Japan, Chem. Soc, 60, pp. 3373-3378, 1987, no month given.

* cited by examiner

PHOTO BLEACH LIPOPHILIC FLUID CLEANING COMPOSITIONS

CROSS-REFERENCE TO RELATED APPLICATIONS

This application claims priority under 35 U.S.C. § 119(e) to U.S. Provisional Application Serial No. 60/483,351 filed June 27, 2003.

FIELD OF THE INVENTION

The present invention relates to lipophilic fluid cleaning compositions having bleaching capabilities, and processes of making and using same.

BACKGROUND OF THE INVENTION

Certain fabric types and constructions require dry cleaning. Dry cleaning typically involves the use of non-aqueous, lipophilic fluids as the solvent or cleaning solution. While cleaning with lipophilic fluids eliminates or minimizes fabric damage, lipophilic fluids have poor hydrophilic and/or combination soil removal capabilities. However, such soils may be efficiently removed by cleaning additives. Unfortunately cleaning additives, such as bleaching materials are sparingly soluble in lipophilic fluids, and ineffective in lipophilic fluids as such materials deposit unevenly on fabrics thus causing fabric damage. As a result, pre-treating and/or pre-spotting compositions are used to remove tough soils. As, pre-treating and/or pre-spotting are time consuming and generally limited to spot removal, there is a need for compositions that can be used to provide a lipophilic fluid with bleaching capabilities, lipophilic fluid cleaning compositions having bleaching capabilities and processes of making and using same.

SUMMARY OF THE INVENTION

The present invention relates to compositions comprising a photosenitizer that can be used to provide a lipophilic fluid with bleaching capabilities, lipophilic fluid cleaning compositions having bleaching capabilities and processes of making and using same.

These and other aspects, features and advantages will become apparent to those of ordinary skill in the art from a reading of the following detailed description and the appended claims.

DETAILED DESCRIPTION OF THE INVENTION

Definitions

The term "fabrics" and "fabric" used herein is intended to mean any article that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The term "soil" means any undesirable substance on a fabric. By the terms "water-based" or "hydrophilic" soils, it is meant that the soil comprised water at the time it first came in contact with the fabric article, or the soil retains a significant portion of water on the fabric article. Examples of water-based soils include, but are not limited to beverages, many food soils, water soluble dyes, bodily fluids such as sweat, urine or blood, outdoor soils such as grass stains and mud.

As used herein, the articles a and an when used in a claim, for example, "an emulsifier" or "a sensitizer" is understood to mean one or more of the material that is claimed or described.

Unless otherwise noted, all component or composition levels are in reference to the active level of that component or composition, and are exclusive of impurities, for example, residual solvents or by-products, which may be present in commercially available sources.

All percentages, ratios and proportions herein are by weight, unless otherwise specified. All temperatures are in degrees Celsius (° C.) unless otherwise specified. All measurements are in SI units unless otherwise specified. All documents cited are in relevant part, incorporated herein by reference.

Lipophilic Fluid Cleaning Compositions Having Bleaching Capabilities

In use versions of Applicants' cleaning compositions may comprise greater than about 1 ppm, from about 1 ppm to about 1,000 ppm, from about 5 ppm to about 500 ppm, or even from about 10 ppm to about 300 ppm of a senitizer; from about greater than 100 ppm, from about 100 ppm to about 10,000 ppm, from about 200 ppm to about 5,000 ppm, or from even from about 500 ppm to about 2,000 ppm of an extender with the balance of said cleaning compositions being a lipophilic fluid or a mixture of a lipophilic fluid and an adjunct ingredient.

Photosenitizer Compositions

Applicants have discovered that certain photosenitizer compositions are unexpectedly suitable for incorporation into lipophilic fluids. Suitable photosenitizer compositions typically contain a senitizer, and an extender, and may contain optional ingredients such as anionic, cationic, nonionic, and zwitterionic surfactants. Solid compositions, based on total weight of said composition, may comprise from about 0.1% to about 50%, from about 1% to about 25%, or even from about 5% to about 20% of a senitizer; from about 1% to about 99.9%, from about 5% to about 90%, or from even from about 10% to about 50% of an extender with the balance of said compositions being a an optional/adjunct. Such solid compositions include, but are not limited to, powders and granules.

Fluid photosenitizer compositions may comprise, based on the total weight of said composition, from about 0.1% to about 50%, from about 1% to about 25%, or even from about 5% to about 20% of a senitizer; from about 1% to about 99.9%, from about 5% to about 90%, or from even from about 10% to about 50% of an extender with the balance of said compositions with the balance of said cleaning compositions being a lipophilic fluid or a mixture of a lipophilic fluid and an optional/adjunct ingredient.

The aforementioned solid photosenitizer compositions and fluid photosenitizer compositions may be packaged in a kit containing instructions for use.

Process of Making

While not being bound by theory, Applicants believe that formation and concentration of bleaching species other than singlet oxygen is a function of at least 4 variables: reactant concentration, time, oxygen concentration of the reactant mixture, and photon flux. As a result, while Applicants, cleaning compositions may be made by combining a photosensitizer, and extender, any lipophilic fluid solvent and any optional ingredients, light energy coming from light having a wavelength that can be absorbed by that of the photosensitizer is minimized and/or the oxygen amount of oxygen in the composition or to which the composition is exposed is minimized. For the purposes of the present invention the wavelength of light that any photosensitizer will absorb is determined by the Light Absorbance Test found in the Test Methods Section of the present specification. For purposes of the present invention the minimization of light energy that can be absorbed by the photosensitzer means that during processing such compositions are generally exposed to such wavelength of light at one of the following levels: less than about 1 milliwatt per square meter of solution surface exposed to said light, less than about $1\times10^{-4}$ watts per square meter of solution surface exposed to said light, or even less than about 1 microwatt per square meter of solution surface exposed said light. For purposes of the present invention the minimization of oxygen means that during processing the compositions comprise less than about $1\times10^{-2}$ moles of oxygen per liter, less than about $1\times10^{-3}$ moles of oxygen per liter, and even less than about $1\times10^{-4}$ moles of oxygen per liter.

In use cleaning compositions may be made by exposing the cleaning compositions described herein to light having a wavelength that can be absorbed by that of the photosensitizer and sufficient oxygen to provide said composition with a dissolved oxygen content of greater than about $1\times10^{-9}$ moles per liter, greater than about $1\times10^{-6}$ moles per liter, or even greater than about $1\times10^{-3}$ moles per liter. The amount of such light energy that is required to produce such in use compositions is typically greater than about $1\times10^{-4}$ milliwatts per square meter of solution surface exposed to said light, greater than about 1 milliwatt per square meter of solution surface exposed to said light, or even greater than $1\times10^{-2}$ watts/square meter of solution surface exposed to said light. Said light energy may be provided by any suitable source, including but not limited a light source located in a domestic appliance, said appliance being suitable for cleaning fabrics.

Method of Using

Items, including but not limited to fabrics, may be cleaned by contacting said item with in use version of Applicants' lipophilic fluid cleaning compositions. As will be appreciated by the skilled artisan, contacting includes but is not limited to, immersion and spraying. Such in use composition may be made during the time that they are in contact with the item or items that are to be cleaned.

Suitable Materials

Suitable materials for making Applicants' lipophilic fluid cleaning compositions having bleaching capabilities and bleaching compositions are as follows:

Suitable sensitizers include any known sensitizer or mixture of sensitizers that generate singlet oxygen or superoxide. For example, said sensitizer may be selected from the group consisting porphyrins, phthalocyanines, $C_8$-$C_{70}$ aromatics, superoxide sensitizers, and mixtures thereof. Examples of suitable singlet oxygen sensitizers include perinaphthenone, thioxanthone, acetonaphthenone, Buckminsterfullerane, 2'-Acetonaphthone, Acridine, 9,10-Dibromoanthracene, Coronene, 9-Fluorenone, Helianthrene, Phenazine, 4-methoxy-pivalothiophenone, Pyrene, Perylene, Perinapthanone, Quinoxaline, Riboflavin tetraacetate, Rubrene, p-Terphenyl, α-Terthienyl, Tetracene, Dimethoxy thiobenzophenone, Thiocoumarin. Examples of superoxide sensitizers include triethanolamine substituted silicon phthalocyanines, curcumin, tolylthio benzophenone. Such materials may be obtained from Sigma-Aldrich of Milwaukee, Wis. U.S.A.

Suitable extenders include species that form adducts with singlet oxygen or superoxide. For example, suitable singlet oxygen extenders include extenders selected from the group consisting of furan, substituted furans, polyethoxylates, alkyl polyethoxylates, polynuclear aromatics, imidazole, substituted imidazoles, pyrrole, substituted pyrroles, and mixtures thereof. Examples of suitable extenders include: 9,10-dimethyl anthracene, Furfuryl alcohol, 2-Furoic acid, 3-Furoic acid, 3-Furanmethanol, 2-benzofurancarboxylic acid, 9,10-Dimethylanthracene, 1,4-Dimethylnaphthalene, Furfural, 2,5 dimethyl furan and mixtures thereof. Such materials may be obtained from Sigma-Aldrich of Milwaukee, Wis. U.S.A. Additional materials that may be useful as extenders include surfactants, such as alkyl ethoxylates, for example, Neodol™ 91-2.5 which is supplied Shell Chemicals of Houston, Tex. U.S.A. Such surfactants can function as cleaning adjuncts and as extenders.

As used herein, "lipophilic fluid" means any liquid or mixture of liquid that is immiscible with water at up to 20% by weight of water. In general, a suitable lipophilic fluid can be fully liquid at ambient temperature and pressure, can be an easily melted solid, e.g., one which becomes liquid at temperatures in the range from about 0° C. to about 60° C., or can comprise a mixture of liquid and vapor phases at ambient temperatures and pressures, e.g., at 25° C. and 1 atm. of pressure.

It is preferred that the lipophilic fluid herein be inflammable or, have relatively high flash points and/or low VOC characteristics, these terms having conventional meanings as used in the dry cleaning industry, to equal or, preferably, exceed the characteristics of known conventional dry cleaning fluids.

Non-limiting examples of suitable lipophilic fluid materials include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

"Siloxane" as used herein means silicone fluids that are non-polar and insoluble in water or lower alcohols. Linear siloxanes (see for example U.S. Pat. Nos. 5,443,747, and 5,977,040) and cyclic siloxanes are useful herein, including the cyclic siloxanes selected from the group consisting of octamethyl-cyclotetrasiloxane (tetramer), dodecamethyl-cyclohexasiloxane (hexamer), and preferably decamethyl-cyclopentasiloxane (pentamer, commonly referred to as "D5"). A preferred siloxane comprises more than about 50% cyclic siloxane pentamer, more preferably more than about 75% cyclic siloxane pentamer, most preferably at least about 90% of the cyclic siloxane pentamer. Also preferred for use herein are siloxanes that are a mixture of cyclic siloxanes having at least about 90% (preferably at least about 95%) pentamer and less than about 10% (preferably less than about 5%) tetramer and/or hexamer.

The lipophilic fluid can include any fraction of dry-cleaning solvents, especially newer types including fluorinated solvents, or perfluorinated amines. Some perfluorinated amines such as perfluorotributylamines, while unsuitable for use as lipophilic fluid, may be present as one of many possible adjuncts present in the lipophilic fluid-containing composition.

Other suitable lipophilic fluids include, but are not limited to, diol solvent systems e.g., higher diols such as $C_6$ or $C_8$ or higher diols, organosilicone solvents including both cyclic and acyclic types, and the like, and mixtures thereof.

Non-limiting examples of low volatility non-fluorinated organic solvents include for example OLEAN® and other polyol esters, or certain relatively nonvolatile biodegradable mid-chain branched petroleum fractions.

Non-limiting examples of glycol ethers include propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether.

Non-limiting examples of other silicone solvents, in addition to the siloxanes, are well known in the literature, see, for example, Kirk Othmer's Encyclopedia of Chemical Technology, and are available from a number of commercial sources, including GE Silicones, Toshiba Silicone, Bayer, and Dow Corning. For example, one suitable silicone solvent is SF-1528 available from GE Silicones.

Non-limiting examples of glycerine derivative solvents include materials having the following structure:

Non-limiting examples of suitable glycerine derivative solvents for use in the methods and/or apparatuses of the present invention include glyercine derivatives having the following structure:

Structure I

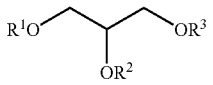

wherein $R^1$, $R^2$ and $R^3$ are each independently selected from: H; branched or linear, substituted or unsubstituted $C_1$-$C_{30}$ alkyl, $C_2$-$C_{30}$ alkenyl, $C_1$-$C_{30}$ alkoxycarbonyl, $C_3$-$C_{30}$ alkyleneoxyalkyl, $C_1$-$C_{30}$ acyloxy, $C_7$-$C_{30}$ alkylenearyl; $C_4$-$C_{30}$ cycloalkyl; $C_6$-$C_{30}$ aryl; and mixtures thereof. Two more of $R^1$, $R^2$ and $R^3$ together can form a $C_3$-$C_8$ aromatic or non-aromatic, heterocyclic or non-heterocyclic ring.

Non-limiting examples of suitable glycerine derivative solvents include 2,3-bis(1,1-dimethylethoxy)-1-propanol; 2,3-dimethoxy-1-propanol; 3-methoxy-2-cyclopentoxy-1-propanol; 3-methoxy-1-cyclopentoxy-2-propanol; carbonic acid (2-hydroxy-1-methoxymethyl)ethyl ester methyl ester; glycerol carbonate and mixtures thereof.

Non-limiting examples of other environmentally-friendly solvents include lipophilic fluids that have an ozone formation potential of from about 0 to about 0.31, lipophilic fluids that have a vapor pressure of from about 0 to about 0.1 mm Hg, and/or lipophilic fluids that have a vapor pressure of greater than 0.1 mm Hg, but have an ozone formation potential of from about 0 to about 0.31. Non-limiting examples of such lipophilic fluids that have not previously been described above include carbonate solvents (i.e., methyl carbonates, ethyl carbonates, ethylene carbonates, propylene carbonates, glycerine carbonates) and/or succinate solvents (i.e., dimethyl succinates).

As used herein, "ozone reactivity" is a measure of a VOC's ability to form ozone in the atmosphere. It is measured as grams of ozone formed per gram of volatile organics. A methodology to determine ozone reactivity is discussed further in W. P. L. Carter, "Development of Ozone Reactivity Scales of Volatile Organic Compounds", Journal of the Air & Waste Management Association, Vol. 44, Pages 881-899, 1994. "Vapor Pressure" as used can be measured by techniques defined in Method 310 of the California Air Resources Board.

Preferably, the lipophilic fluid comprises more than 50% by weight of the lipophilic fluid of cyclopentasiloxanes, ("D5") and/or linear analogs having approximately similar volatility, and optionally complemented by other silicone solvents.

Optional/Adjunct Ingredients

While not essential for the purposes of the present invention, the non-limiting list of optional ingredients illustrated hereinafter are suitable for use in the instant cleaning compositions and may be desirably incorporated in certain embodiments of the invention, for example to assist or enhance cleaning performance, for treatment of the substrate to be cleaned, or to modify the aesthetics of the cleaning composition as is the case with perfumes, colorants, dyes or the like. The precise nature of these additional components, and levels of incorporation thereof, will depend on the composition and the nature of the cleaning operation for which it is to be used. Suitable adjunct materials include, but are not limited to, additional surfactants beyond those that function as extenders, builders, dye transfer inhibiting agents, dispersants, enzymes, and enzyme stabilizers, catalytic metal complexes, polymeric dispersing agents, clay soil removal/anti-redeposition agents, brighteners, suds suppressors, dyes, perfumes, structure elasticizing agents, fabric softeners, carriers, hydrotropes, processing aids and/or pigments. Suitable examples of such optional/adjuncts ingredients are found in U.S. Pat. Nos. 5,576,282, 6,306,812 B1 and 6,326,348 B1 that are incorporated by reference.

Test Methods

Light Absorbance Test (Process for determining wavelength of light absorbed by a sensitizer)

1.) Dissolve a sufficient amount of photosensitizer of choice in the solvent of choice to obtain a maximum absorbance, between 250 nanometers and 700 nanometers, of 1.
2.) For purposes of this invention, any wavelength of light wherein such sensitizer has an absorbance of 0.01 is considered to be a wavelength that is absorbed by the photosensitizer

EXAMPLES

Example 1

The following liquid bleach composition is prepared by dissolving thioxanthone, dimethyl furan and the cleaning adjuncts in decamethylcyclopentasiloxane (D5) with stirring while avoiding exposure to light.

| | |
|---|---|
| Thioxanthone | 6% |
| Dimethyl furan | 30% |
| Cleaning adjuncts | 30% |
| Decamethylcyclopentasiloxane | balance |

100 ml of the above described bleach composition is added to 30 liters of D5 in a suitable washing machine and the wash liquor is illuminated with a light source emitting in at least one of the absorbance peaks of thioxanthone while being agitated for a period of 15 minutes. The wash liquor is removed and the fabrics are rinsed with a further 10 liters of D5.

Example 2

The following solid bleach composition is made by mixing thioxanthone, imidazole and the cleaning adjuncts.

| | |
|---|---|
| Thioxanthone | 12% |
| Imidazole | 60% |
| Cleaning adjuncts | balance |

50 g of the above described bleach composition is added to 30 liters of D5 in a suitable washing machine and the wash liquor is illuminated with a light source emitting in at least one of the absorbance peaks of thioxanthone while being agitated for a period of 15 minutes. The wash liquor is removed and the fabrics are rinsed with a further 10 liters of D5.

Example 3

A liquid bleach composition is prepared by dissolving acetonaphthone and Neodol 92-2.5 in dipropylene glycol t-butyl ether (DGBE):

| | |
|---|---|
| Acetonaphthone | 12% |
| Neodol 91-2.5 | 70% |
| dipropylene glycol t-butyl ether | balance |

100 ml of the above described bleach composition is added to 30 liters of DGBE in a suitable washing machine and the wash liquor is illuminated with a light source emitting in at least one of the absorbance peaks of acetonaphthone while being agitated for a period of 15 minutes. The wash liquor is removed and the fabrics are rinsed with a further 10 liters of DGBE Example 4

A liquid bleach composition is prepared by dissolving Thixanthone and Neodol 92-2.5 in DGBE:

| | |
|---|---|
| Acetonaphthone | 6% |
| Neodol ™ 91-2.5 | 84% |
| dipropylene glycol t-butyl ether (DGBE) | balance |

100 ml of the above described bleach composition is added to 30 liters of DGBE in a suitable washing machine and the wash liquor is illuminated with a light source emitting in at least one of the absorbance peaks of thioxanthone while being agitated for a period of 15 minutes. The wash liquor is removed and the fabrics are rinsed with a further 10 liters of DGBE While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning composition prepared by a process of dissolving:

a.) from about 1 ppm to about 1000 ppm of a sensitizer selected from the group consisting porphyrins, phthalocyanines, $C_8$-$C_{70}$ aromatics, superoxide sensitizers, and mixtures thereof; and b.) from about 100 ppm to about 10,000 ppm of an extender selected from the group consisting of furan, substituted furans, alkyl ethoxylates, polyethoxylates, alkyl polyethoxylates, polynuclear aromatics, imidazole, substituted imidazoles, pyrrole, substituted pyrroles, and mixtures thereof; into c.) the balance of said cleaning composition, said balance consisting essentially of a siloxane lipophilic fluid, and optionally an adjunct ingredient; wherein said composition comprises less than about $1\times10^{-4}$ moles per liter of oxygen introduced into said composition during said process; and d.) wherein said process is conducted while avoiding exposure to light.

2. A cleaning composition according to claim 1 comprising:

a.) from about 5 ppm to about 500 ppm of said sensitizer;

b.) from about 200 ppm to about 5,000 ppm of said extender.

3. A cleaning composition according to claim 2 comprising:

a.) from about 10 ppm to about 300 ppm of said sensitizer;

b.) from about 500 ppm to about 2,000 ppm of said extender.

4. The cleaning composition of claim 1 wherein:

a.) said sensitizer is selected from the group consisting of thioxanthone, acetonaphthone, and mixtures thereof;

b.) said extender is selected from the group consisting of alkyl ethoxylates, imidazole, 2,5 dimethyl furan, and mixtures thereof.

5. A cleaning composition according to claim 1 wherein said siloxane lipophilic fluid consists essentially of more than 50% by weight of decamethylcyclopentasiloxane.

6. A method of cleaning a fabric or surface comprising the steps of;

a.) providing the cleaning composition of claim 1 with sufficient oxygen such that said cleaning composition comprises oxygen at a level of $1\times10^{-9}$ moles per liter of said cleaning composition and sufficient light energy to generate bleaching species; and b.) contacting said fabric or surface with said cleaning composition during or after said bleaching species are generated.

7. The method of claim 6 wherein said light energy is, based on light having a wavelength that is absorbed by the sensitizer employed, sufficient to yield greater than $1\times10^{-4}$ milliwatts/square meter of solution surface exposed to said light.

8. The method of claim 6 wherein said light energy is provided by a light source located in a domestic appliance suitable for cleaning fabrics.

* * * * *

UNITED STATES PATENT AND TRADEMARK OFFICE

CERTIFICATE OF CORRECTION

PATENT NO. : 7,345,016 B2
APPLICATION NO. : 10/875908
DATED : March 18, 2008
INVENTOR(S) : Alan David Willey et al.

It is certified that error appears in the above-identified patent and that said Letters Patent is hereby corrected as shown below:

Column 5

Line 40, after "Two", insert -- or --.

Signed and Sealed this

Twenty-ninth Day of July, 2008

JON W. DUDAS
*Director of the United States Patent and Trademark Office*